US005334819A

United States Patent [19]

Lin

[11] Patent Number: 5,334,819

[45] Date of Patent: Aug. 2, 1994

[54] INSTANT HEATING TYPE WATER HEATERS

[76] Inventor: Hsiao-Chih Lin, 8F-6, No. 100, Sec. 02, Hoping E. Rd., Taipei, Taiwan

[21] Appl. No.: 148,360

[22] Filed: Nov. 8, 1993

[51] Int. Cl.[5] ..... H05B 6/10

[52] U.S. Cl. ..... 219/628; 219/629; 219/675

[58] Field of Search ..... 219/10.51, 628, 629, 219/630, 632, 675, 677

[56] References Cited

U.S. PATENT DOCUMENTS 1,577,276 3/1926 Whitten ..... 219/10.51
2,273,037 2/1942 Hothersall ..... 219/10.51
4,602,140 7/1986 Sobolewski ..... 219/10.51
5,262,621 11/1993 Hu et al. ..... 219/10.51

*Primary Examiner*—Philip H. Leung
*Attorney, Agent, or Firm*—Browdy and Neimark

[57] ABSTRACT

A water heater according to one embodiment of the invention includes a housing, a heating unit, and a preheating unit consisted of a transformer, a transistor, a heating coil, a rectifier that release heat for heating water when operated, the heating unit including a magnetic device and two stainless steel plates insulated from the magnetic device at two opposite sides, the stainless steel plates being heated by the magnetic force from the magnetic device to heat water passing through.

2 Claims, 6 Drawing Sheets

INSTANT HEATING TYPE WATER HEATERS

BACKGROUND OF THE INVENTION

The present invention relates to instant heating type water heaters which utilize magnetic force to heat stainless steel plates so as to heat water efficiently.

Conventional home use water heaters can be gathered into two groups, namely, the ignition type water heaters which burn fuel gas to heat water, and the resistance type water heaters. An ignition type water heater is dangerous in use because it burns fuel gas. Theoretically, a resistance type water heater is more safe in use because it uses a nickel-chrome wire connected with a ground wire to produce heat upon the connection of power supply. The drawback of a resistance type water heater is its consumption of electricity and the risk of an electrical leakage.

SUMMARY OF THE INVENTION

The present invention has been accomplished under the aforesaid circumstances. It is therefore an object of the present invention to provide a water heater which greatly saves power supply. It is another object of the present invention to provide a water heater which eliminates the installation of a ground wire.

According to one embodiment of the present invention, a water heater comprises a housing, a heating unit, and a pre-heating unit. The pre-heating unit is a part of the electronic circuit of the water heater, consisted of a transformer, a transistor, a heating coil, and a rectifier. As the electric circuit of the water heater is turned on, the transformer and the transistor produce heat at about 50° C., the heating coil will produce heat at about 80° C., and the rectifier will produce heat at about 70° C. The heat radiated from these electronic components is fully utilized to heat water. The heating unit comprises a magnetic device and two stainless steel plates insulated from the magnetic device at two opposite sides, and two symmetrical water passage ways to guide water through the stainless steel plates. As the magnetic device is energized, the stainless steel plates are heated by the magnetic force from the magnetic device, and therefore water is efficiently heated while passing through the stainless steel plates.

DETAILED DESCRIPTION OF TEE PREFERRED EMBODIMENTS

Figure 1:
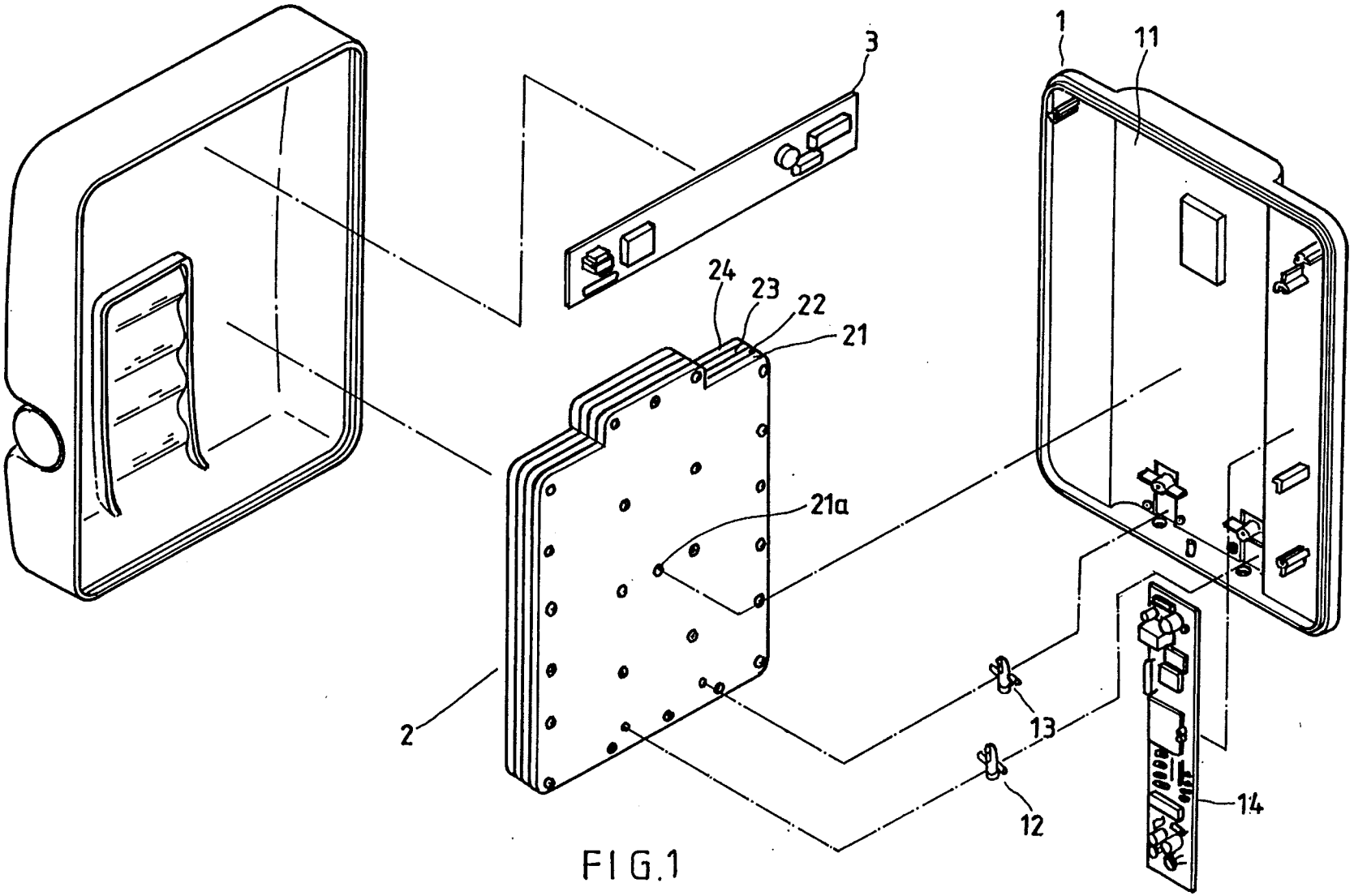
FIG. 1 is an exploded view of an instant heating type water heater according to one embodiment of the present invention.
Figures 2, 2A:
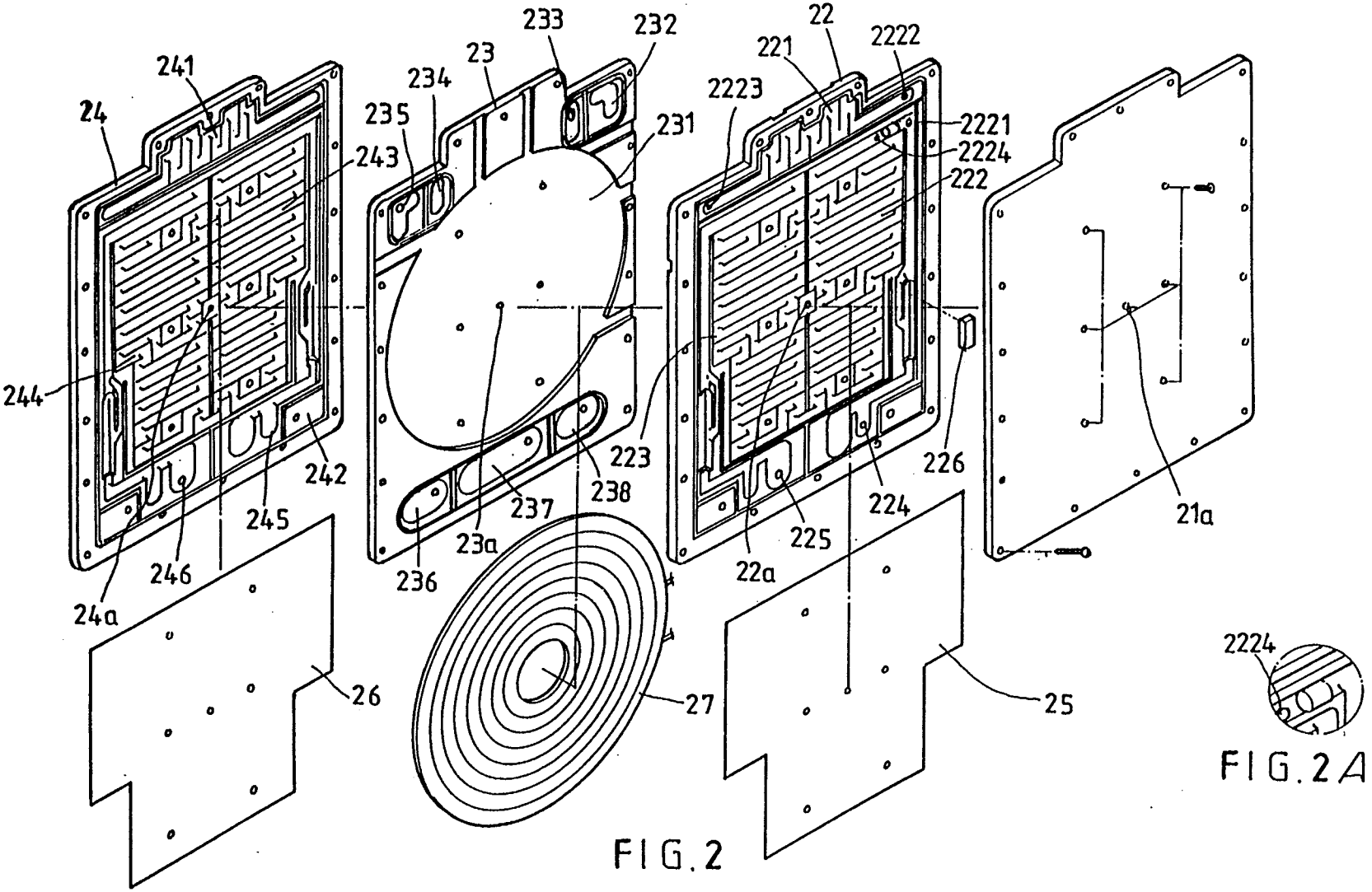
FIG. 2 is an exploded view of the heating unit of the instant heating type water heater of FIG. 1.
FIG. 2A is a partial view in an enlarged scale compared to FIG. 2, of the second heat-resisting plastic plate of the heating unit of the instant heating type water heater of FIG. 1.
Figure 3:
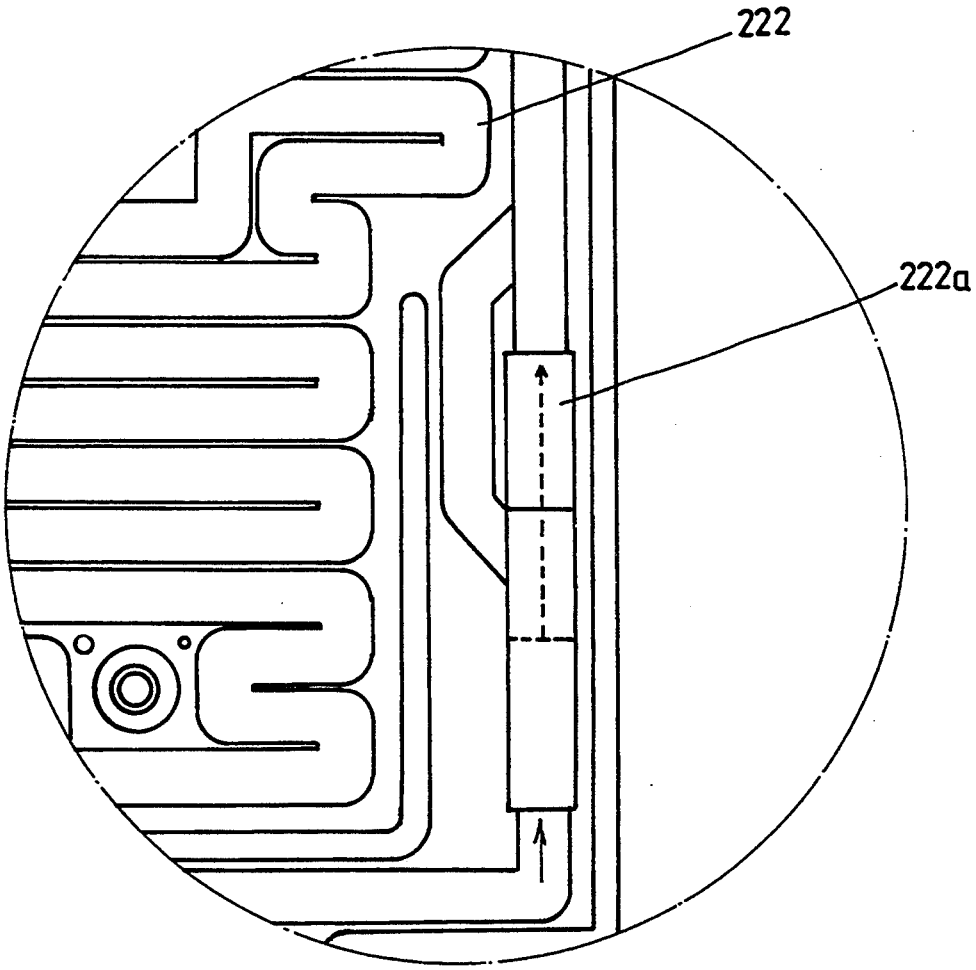
FIG. 3 is a partial view in an enlarged scale of the second heat-resisting plastic plate of the heating unit of the instant heating type water heater of FIG. 1.
Figure 4:
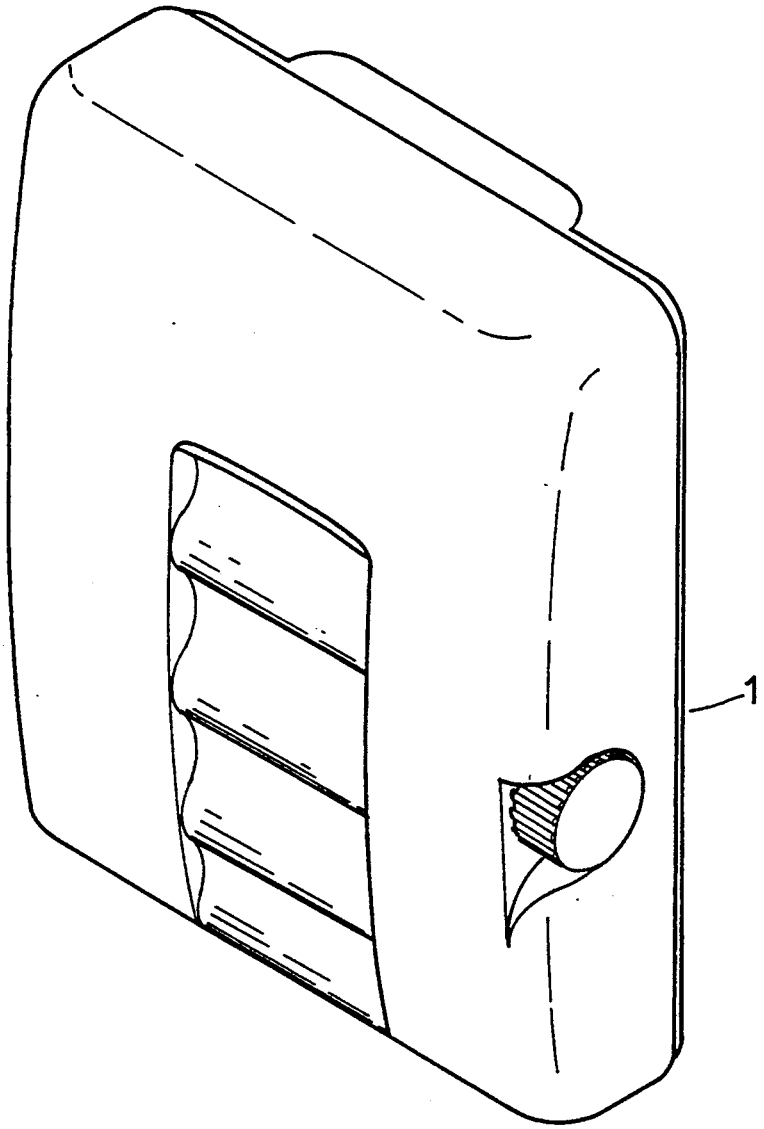
FIG. 4 is an elevational view of the instant heating type water heater of FIG. 1.

Referring to FIGS. 1, 2, 3, and 4, an instant heating type water heater in accordance with one embodiment of the present invention is shown, generally comprised of a housing 1, a heating unit 2, and a pre-heating unit 3. The housing 1 comprises a water intake pipe 12 and a water outlet pipe 13 on the outside, and a PC board (printed circuit board) 14 on the inside. The heating unit 2 is fastened in a storage chamber 11 inside the housing 1, comprised of a first heat-resisting plastic plate 2, a second heat-resisting plate 22, a third heat-resisting plastic plate 23, a fourth heat-resisting plastic plate 24, a first stainless steel plate 25 retained between and covered within the first and second heat-resisting plastic plates 21;22, a second stainless steel plate 26 retained between and covered with the third and fourth heat-resisting plastic plates 23;24, and an electromagnetic device 27 retained between and covered within the second and third heat-resisting plastic plates 22;23. The second heat-resisting plastic plate 22 comprises a top water course 221, a right water course 222, a left water course 223, a water inlet 224 and a water outlet 225 at the bottom. A magnet 226 is placed in the right water course 222. The first heat-resisting plastic plate 21 is made symmetrical to the second heat-resisting plastic plate 22. The third heat-resisting plastic plate 23 comprises a circular center water course 231, and a plurality of upper water grooves 232;233;234;235 and a plurality of lower water grooves 236;237;238 disposed at two opposite sides relative to the circular center water course 231. The fourth heat-resisting plastic plate 24 comprises a top water course 241, a right water course 243, a left water course 244, a cold water inlet 242 and a water hole 245 and a hot water outlet 246 at the bottom. The pre-heating unit 3 is fastened inside the housing 1, consisted of a set of electronic elements including transformer, transistor, rectifier, electric heating coil, etc. The first and second heat-resisting plastic plates 21;22 and the first stainless steel plate 25 are fastened together by screws, with the first stainless steel plate 25 retained between the first and second heat-resisting plastic plates 21;22. The third and fourth heat-resisting plastic plates 23;24 and the second stainless steel plate 26 are fastened together by screws and peripherally sealed, with the second stainless steel plate 26 retained between the third and fourth heat-resisting plastic plates 23;24. The second and third heat-resisting 22;23 are than fastened together by screws and peripherally sealed, with the electromagnetic device 27 retained within the circular center water course 231 of the third heat-resisting plastic plate 23 for permitting the two opposite lead wires of the electromagnetic device 27 to be extended out of the heating unit 2 through wire holes 22*a*;21*a* on the second and first heat-resisting plastic plates 22;21 and wire holes 23*a*;24*a* on the third and fourth heat-resisting plastic plates 23;24.

When in use, water is guided from the water intake pipe 12 of the housing 1 into the heating unit 2 through the cold water inlet 242 of the fourth heat-resisting plastic plate 24, to flow through the water groove 238 of the third heat-resisting plastic plate 23 into the water inlet 224 of the second heat-resisting plastic plate 22 so as to move the magnet 226 upwards, therefore water is allowed to flow through a hole 2221 on the right water course 222 of the second heat-resisting plastic plate 22 into the water groove 232, then to flow through a hole 2222 into the top water course 221 and then flow out of the top water course 221 through a hole 2223 into the water groove 235, then to flow from the water groove 235 to the top water course 241 on the fourth heat-resisting plastic plate 24, then to flow through the water groove 233 of the third heat-resisting plastic plate 23 into the right water course 222 of the second heat-resisting plastic plate 22 through a hole 2224 thereon, then to flow through the left water course 223 and the water outlet 225 of the second heat-resisting plastic plate 22 and then through the water groove 237 of the third heat-resisting plastic plate 23 into the water hole 245 on the fourth heat-resisting plastic 24, and then to flow through the right water course 243 and then the left water course 244 so as to finally flow out of the water heater through the water outlet pipe 13 via the hot water outlet 246. The aforesaid arrangement allows water to flow through both sides of the electromagnetic device 27 over either stainless steel plate 25;26, and therefore water is heated efficiently.

Figure 5:
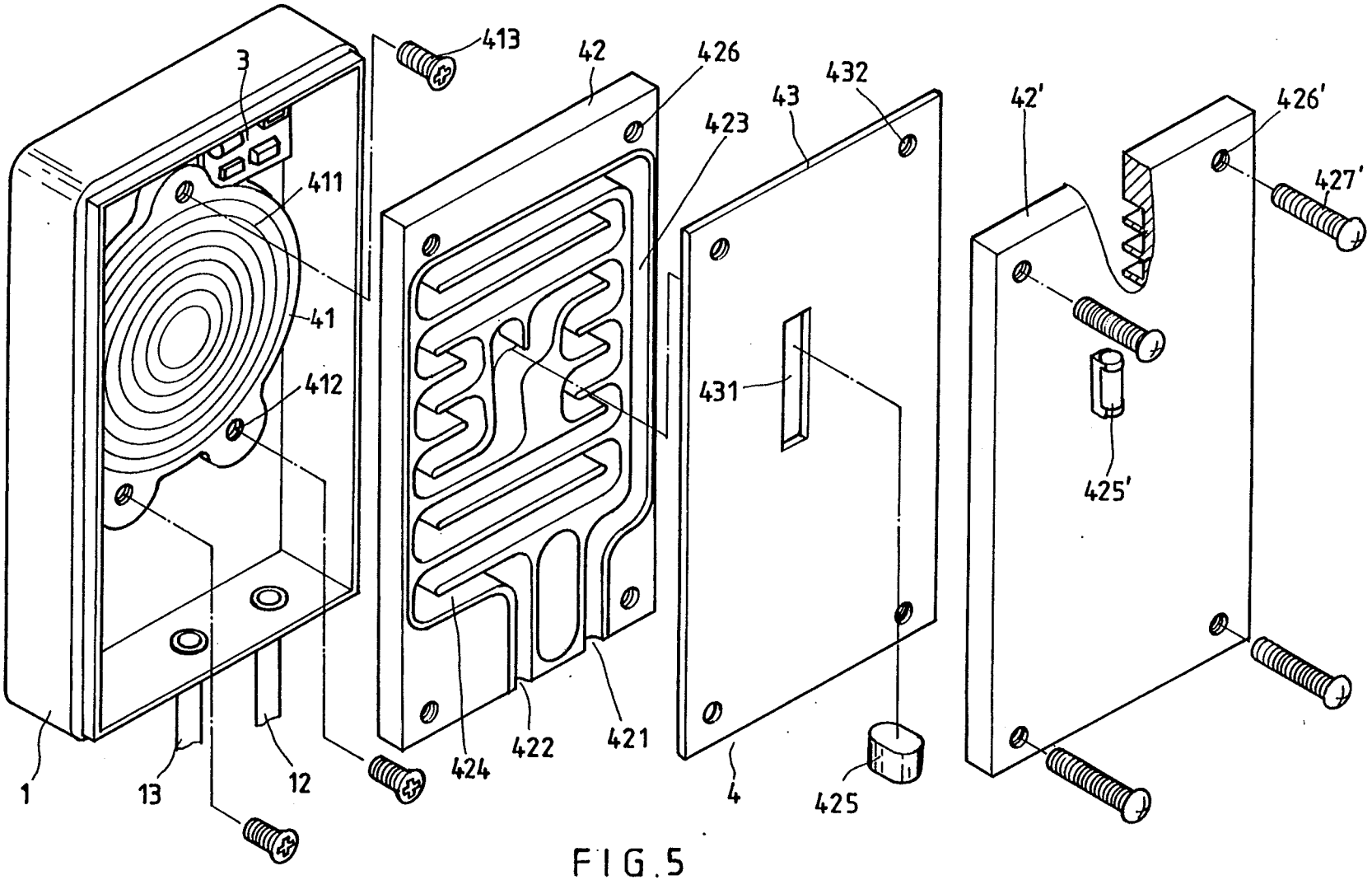
FIG. 5 is an exploded view of an instant heating type water heater according to another embodiment of the present invention.
Figure 6:
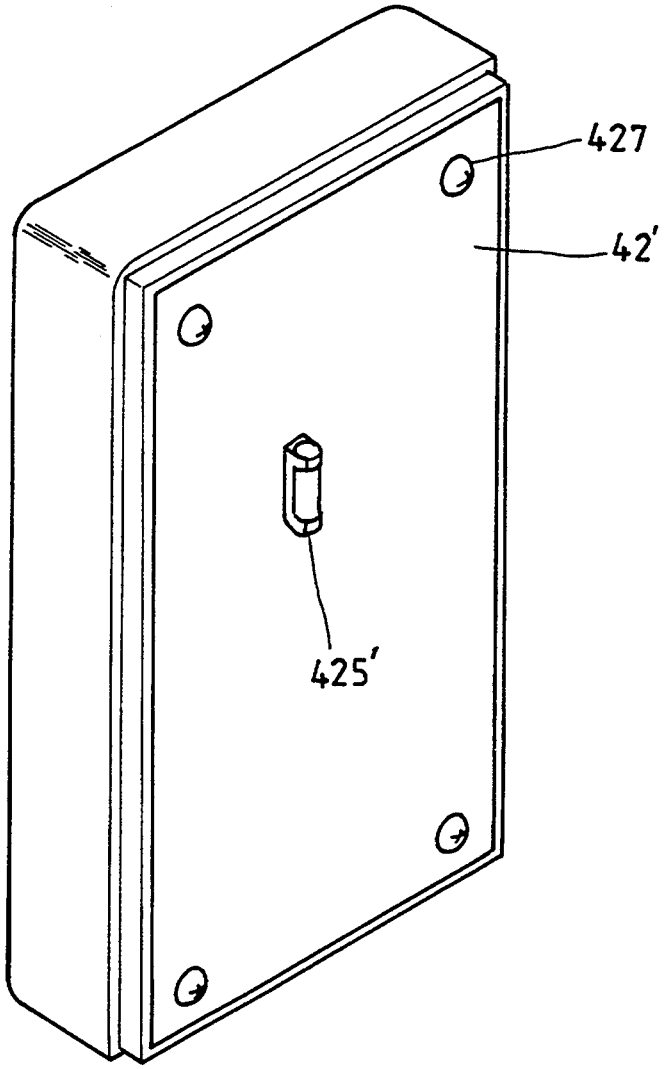
FIG. 6 is an elevational view of the instant heating type water heater of FIG. 5.

Referring to FIGS. 5 and 6, therein illustrated is an alternate form of the present invention, which is also comprised of a housing 1, a heating unit 4, and a pre-heating unit 3. As the housing 1 and the pre-heating unit 3 are identical to that described above, same reference numerals are respectively used. The heating unit 4 is comprised of an electromagnetic device 41, two symmetrical heat-resisting plastic plates, namely, the first heat-resisting plastic plate 42 and the second heat-resisting plastic plate 42', and a stainless steel plate 43. The electromagnetic device 41 comprises a coil 411, and a plurality of screw holes 412. Screws 413 are respectively threaded through the screw holes 412 on the electromagnetic device 41 into respective screw holes (not shown) on the housing 1 to fasten the electromagnetic device 41 to the housing 1 on the inside. The heat-resisting plastic plates 42;42' have respective screw holes 426;426' around the border. The stainless steel plate 43 has screw holes 432 around the border and aligned with the screw holes 426;426' on the heat-resisting plastic plates 42;42' respectively. The heat-resisting plastic plates 42;42' and the stainless steel plate 43 are connected together by threading screws 427 into the screw holes 426;432;426' for permitting the stainless steel plate 43 to be retained between the heat-resisting plastic plates 42;42'. When connected, the gap between heat-resisting plastic plates 42;42' is sealed with a silicone sealing agent. The first heat-resisting plastic plate 42 further comprises a water inlet 421 and a water outlet 422 respectively connected to the water intake pipe 12 and water outlet pipe 13 of the housing 1, and two symmetrical water routes 423;424 respectively extended from the water inlet 421 and the water outlet 422 and then met in the center. A magnet 425 is placed within the first heat-resisting plastic plate 42 at the location where the water routes 423;424 converge. The second heat-resisting plastic plate 42' is similar to the first heat-resisting plastic plate 42, comprising a water inlet and a water outlet respectively connected to the water intake pipe 12 and water outlet pipe 13 of the housing 1, and two symmetrical water routes respectively extended from the water inlet water outlet thereof and then met in the center. The second heat-resisting plastic plate 42' further comprises a solenoid switch 425'. The stainless steel plate 43 has a hole 431 at a location corresponding to the magnet 425 on either heat-resisting plastic plate 42;42'.

When in use, water flows from the water intake pipe 12 through the water inlet 421 on either heat-resisting plastic plate 42;42' into the right-hand water route 423 to move the respective magnet 425 upwards, causing the magnet 425 to trigger the solenoid switch 425'. As the solenoid switch 425' is triggered, the pre-heating unit 3 is turned on, causing the coil 411 of the electromagnetic device 41 energized, and therefore a whirl of magnetic force is induced to heat the stainless steel plate 43 for heating water. The flow of water, while being heated by the stainless steel plate 43, flows through the left-hand water route 224 of each heat-resisting plastic plate 42;42' and then comes out of the housing 1 through the hot water outlet pipe 13 via the water outlet 422 of each heat-resisting plastic plate 42;42'. During the operation of the pre-heating unit 3, the electronic elements thereof release heat to heat water which flows through the upper corner area of the heat-resisting plastic plates 42;42'. Therefore, water is efficiently heated. As soon as water is stopped from entering the water intake pipe 12, the magnet 425 moves back to its former position, causing the solenoid switch 425 switched off, and therefore the water heater stops from working.

While only a few embodiments of the present invention have been shown and described, it will be understood that various modifications and changes could be made without departing from the spirit and scope of the invention.

What is claimed is:

1. A water heater comprising:

a housing (1) having a water intake pipe (12) and a water outlet pipe (13) on the outside and a printed circuit board (14) on the inside;

a pre-heating unit (3) fastened inside said housing (1), said pre-heating unit (3) comprising a transformer, a transistor, a rectifier, and an electric heating coil;

a heating unit (2) fastened inside said housing (1), said heating unit (2) comprising a first heat-resisting plastic plate (21), a second heat-resisting plate (22), a third heat-resisting plastic plate (23), a fourth heat-resisting plastic plate (24), a first stainless steel plate (25) retained between and covered within the first and second heat-resisting plastic plates (21;22), a second stainless steel plate (26) retained between and covered with the third and fourth heat-resisting plastic plates (23;24), and an electromagnetic device (27) retained between and covered within the second and third heat-resisting plastic plates (22;23), said second heat-resisting plastic plate (22) comprising a top water course (221), a right water course (222), a left water course (223), a water inlet (224) and a water outlet (225) at the bottom, and a magnet (226) placed in the right water course (222), the first heat-resisting plastic plate (21) being made symmetrical to the second heat-resisting plastic plate (22), the third heat-resisting plastic plate (23) comprising a circular center water course (231), and a plurality of upper water grooves (232;233;234;235) and a plurality of lower water grooves (236;237;238), the fourth heat-resisting plastic plate (24) comprising a top water course (241), a right water course (243), a left water course (244), a cold water inlet (242) and a water hole (245) and a hot water outlet (246) at the bottom, the electromagnetic device having two opposite lead wires extended out of the heating unit (2) through wire holes (22*a*;21*a*) on the second and first heat-resisting plastic plates (22;21) and wire holes (23*a*;24*a*) on the third and fourth heat-resisting plastic plates (23;24); and wherein when in use, water is guided from the water intake pipe (12) of the housing (1) into the heating unit (2) through the cold water inlet (242) of the fourth heat-resisting plastic plate (24), to flow through the water groove (238) and the water inlet (224) and to move the magnet (226) upwards, and then to flow in proper order through a hole (2221) on the right water course (222) of the second heat-resisting plastic plate (22), the water groove (232), a hole (2222) on the top water course (221), the top water course (221), a hole (2223) on the top water course (221), and the water groove (235), and then to flow through the top water course (241), the water groove (233), the right water course (222), and then the left water course (223) and the water outlet (225), and then to flow through the water groove (237), the water hole (245) on the fourth heat-resisting plastic plate (24), and then to flow through the right water course (243) and then the left water course (244) so as to finally flow out of the water heater through the water outlet pipe (13) via the hot water outlet (246).

2. A water heater comprising a housing (1) having a water intake pipe (12) and a water outlet pipe (13), a heating unit (4) fastened inside the housing (1) and controlled to heat water passing through, the heating unit (4) comprising an electromagnetic device (41), a first heat-resisting plastic plate (42), and a second heat-resisting plastic plate (42′) connected to the first heat-resisting plastic plate (42), and a stainless steel plate (43) retained between the first heat-resisting plastic plate (42) and the second heat-resisting plastic plate (42′), the electromagnetic device (41) comprising a coil (411), and a plurality of screw holes (412) respectively fastened to the housing (1) by screws (413), the heat-resisting plastic plates (42;42′) having respective screw holes (426;426′) respectively connected together by screws (427), each heat-resisting plastic plate (42;42′) comprising a water inlet (421) and a water outlet (422) respectively connected to the water intake pipe (12) and water outlet pipe (13) of the housing (1), and two symmetrical water routes (423;424) respectively extended from the water inlet (421) and the water outlet (422) and converge at the center, the first heat-resisting plastic plate (42) further comprising a magnet (425) placed at the location where the water routes (423;424) converge, the second heat-resisting plastic plate (42′) further comprising a solenoid switch (425′), the stainless steel plate (43) having a hole (431) in the center.

* * * * *